US005532677A

United States Patent [19]

Miller

[11] Patent Number: 5,532,677

[45] Date of Patent: Jul. 2, 1996

[54] VARIABLE DISTANCE MARKER

[76] Inventor: John E. Miller, 7408 E. Corrine Dr., Scottsdale, Ariz. 85260

[21] Appl. No.: 269,882

[22] Filed: Jul. 1, 1994

[51] Int. Cl.[6] ..... G08C 21/00

[52] U.S. Cl. ..... 340/286.01; 340/287; 340/323 R; 340/307; 473/150

[58] Field of Search ..... 340/287, 307, 340/323 R, 286.01, 600; 273/32 B, 32 H, 32 R; 356/4

[56] References Cited

U.S. PATENT DOCUMENTS

| | | | |
|---|---|---|---|
| 3,665,494 | 5/1972 | Baumoel | 273/32 B |
| 3,868,692 | 2/1975 | Woodard et al. | 273/32 B |
| 3,898,437 | 8/1975 | Butler | 273/32 B |
| 4,367,526 | 1/1983 | McGeary et al. | 364/411 |
| 4,419,655 | 12/1983 | May | 340/323 R |
| 4,532,712 | 8/1985 | Vistain | 273/32 B |
| 4,880,232 | 11/1989 | Lang | 273/32 B |
| 4,910,677 | 3/1990 | Remedio et al. | 364/410 |
| 5,046,839 | 9/1991 | Krangle | 356/5 |
| 5,095,430 | 3/1992 | Bontio et al. | 364/410 |
| 5,214,679 | 5/1993 | Metcalf | 364/410 |
| 5,298,904 | 3/1994 | Olich | 342/42 |

*Primary Examiner*—John K. Peng
*Assistant Examiner*—Daryl C. Pope
*Attorney, Agent, or Firm*—Parsons & Associates; Don J. Flickinger; Robert A. Parsons

[57] ABSTRACT

A variable distance marker system includes a display mounted in a housing and attached to electronics circuits having a light detector for receiving externally generated light signals. A rechargeable battery and a solar cell array are interconnected for supplying power to the display and circuits. An antenna is mounted in the housing for receiving RF signals and a remote RF transmitter is controllable to transmit an actuating signal to the antenna for altering the display. A remote hand-held light generator is controllable to generate a beam of light onto the light detector for controlling the digits displayed.

19 Claims, 2 Drawing Sheets

FIG. 3
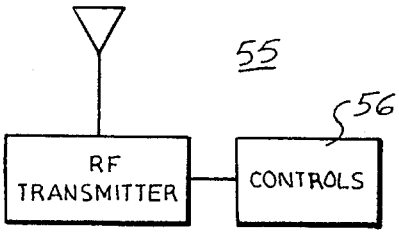
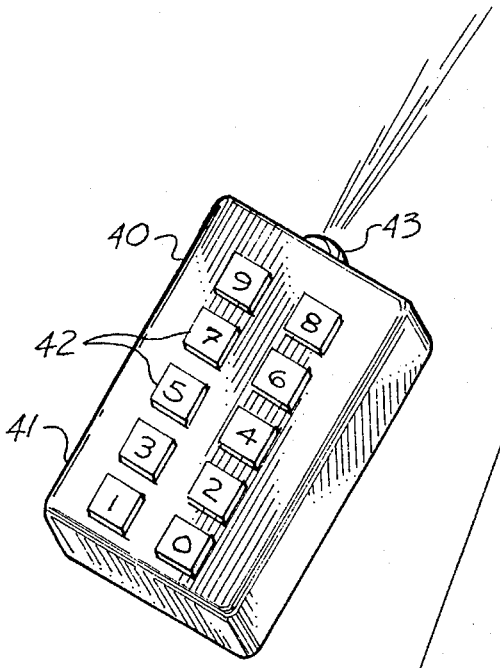
FIG. 4
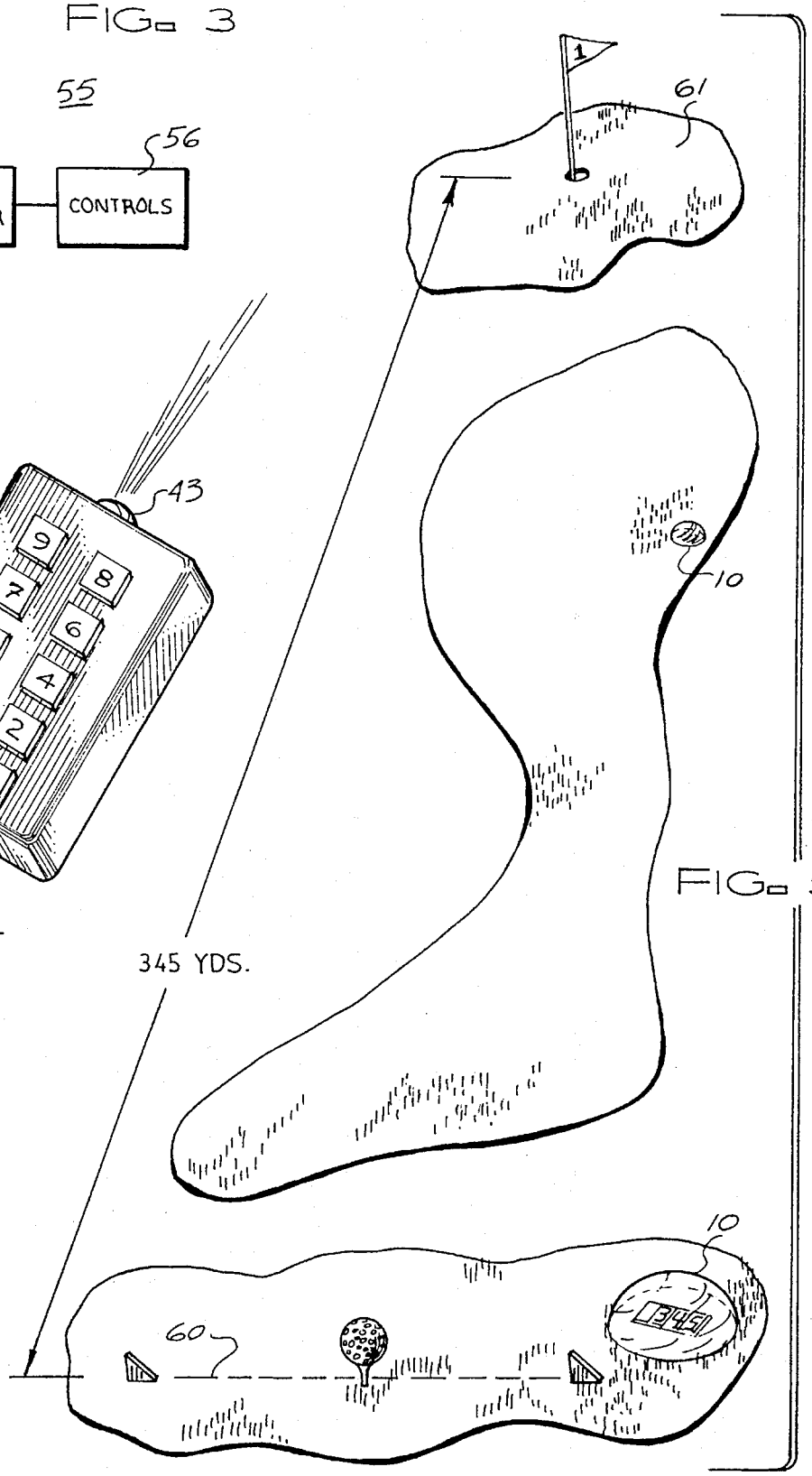
FIG. 5

VARIABLE DISTANCE MARKER

BACKGROUND OF THE INVENTION

1. Field of the Invention

This invention relates to distance markers for sports events.

More particularly, the present invention relates to a variable visual display.

In a further and more specific aspect, the instant invention concerns an externally variable visual display for use in various sports events.

2. Prior Art

In many sports events and the like it is highly desirous to know distances to, or between, various objects or items in a field of play. If these distances change or are purposely changed, fixed distance markers are inaccurate at best.

For example, in the game of golf it is very important to know the distance from the tee and other points, such as on the fairway, to the associated hole or cup. The problem is that most golf courses vary the position of the hole in the green and the tee-off line. Further, because the greens and tee grounds can be quite large in area, these changes of position can alter the distance between tee and associated hole by a substantial amount. Generally, the positions of tee and the associated hole are changed periodically and for various tournaments.

Most clubs or associations provide fixed distance markers, which are generally a simple stake in the ground, indicating the distance from that specific point to the center of the green. However, when the tee position and the hole position are both changed the distance indicated on the distance stake can be off by as much as ten or twenty yards. Further, since the contestant does not know the distance the hole has been moved from the center of the green and since the contestant can only determine the distance the hole has been moved from the fixed distance stake by taking the time to measure it, it is very difficult or even impossible for the contestant to know the exact distance from the hole.

It would be highly advantageous, therefore, to remedy the foregoing and other deficiencies inherent in the prior art.

Accordingly, it is an object of the present invention to provide a, variable distance marker for sporting events.

Another object of the present invention is to provide a variable distance marker for sporting events in which the distance displayed is easily altered.

And another object of the present invention is to provide a variable distance marker for sporting events which can be placed at various positions in the field of play and which can be easily observed.

Still another object of the present invention is to provide a variable distance marker for sporting events which can be placed at various positions in the field of play and which contains its own power source.

Yet another object of the present invention is to provide a variable distance marker system for use in the field of play of various sporting events.

And still another object of the present invention is to provide a new and novel method of conveniently and accurately marking distances in a sporting event.

A further object of the present invention is the provision of an improved method of conveniently and accurately marking distances between the tees, intermediate locations and associated holes on a golf course.

SUMMARY OF THE INVENTION

Briefly, to achieve the desired objects of the instant invention, in accordance with a preferred embodiment thereof, a variable, distance marker is provided which includes a housing having operably mounted therein an externally viewable and electrically actuable visual display including a plurality of variable digits and an input for receiving signals to actuate the display and change the digits and electronics circuits connected to the visual display input for actuating the visual display to display selected digits. Further, control apparatus is mounted in the housing and electrically connected to the electronics circuits for receiving externally generated control signals and supplying the received control signals to the electronics circuits and a power source is connected to the visual display and the electronics circuits for supplying power thereto.

In accordance with a further embodiment of the invention, a method of marking distances in a sporting event is disclosed including the step of providing a housing containing a visual display including a plurality of variable digits viewable externally, electronics circuits connected to the visual display and controllable to actuate the visual display to display selected digits, a light detector connected to the electronics circuits for receiving externally generated light signals, converting the received light signals into control signals and applying the control signals to the electronics circuits, an antenna mounted in the housing and connected to the electronics circuits for receiving RF signals including an actuating signal at a predetermined frequency and applying the actuating signal to the electronics circuits, and a rechargeable battery and interconnected solar cell array or an external power source coupled thereto, for supplying power to the visual display and the electronics circuits. The method also includes the steps of providing a remote portable light generator controllable to generate control signals in the form of a beam of light directable at the light detector and providing an RF transmitter controllable to transmit RF signals to the antenna at the predetermined frequency and positioning the RF transmitter at a base point convenient to at least a first official for the sporting event. A designated position in a field of play for the sporting event, it being desirable for contestants to know the distance from the designated position to a first remote point, is then selected. The housing is positioned in a convenient location at the selected designated position so that the visual display is readily discernable by the contestants and the distance from the housing to the first remote point is determined.

In one preferred embodiment, the remote portable light generator is operated to generate control signals in the form of a beam of light, which beam of light is directed onto the light detector to actuate the visual display to introduce a preset default number into the display. The RF transmitter is subsequently operated to transmit an RF signal to the antenna in the housing each time a change is made in the distance between the determined distance from the housing to the first remote point to modify the preset default number by a number equal to the change in distance between.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 3 is a simplified block diagram of an RF transmitter for use with the variable distance marker of FIG. 1;

FIG. 4 is a view in top plan of a remote portable light generator for use with the variable distance marker of FIG. 1; and FIG. 5 is a simplified perspective view of a typical tee and associated hole in a golf course, illustrating the use of the variable distance marker of FIG. 1.

DETAILED DESCRIPTION OF THE PREFERRED EMBODIMENTS

Figures 1, 2:
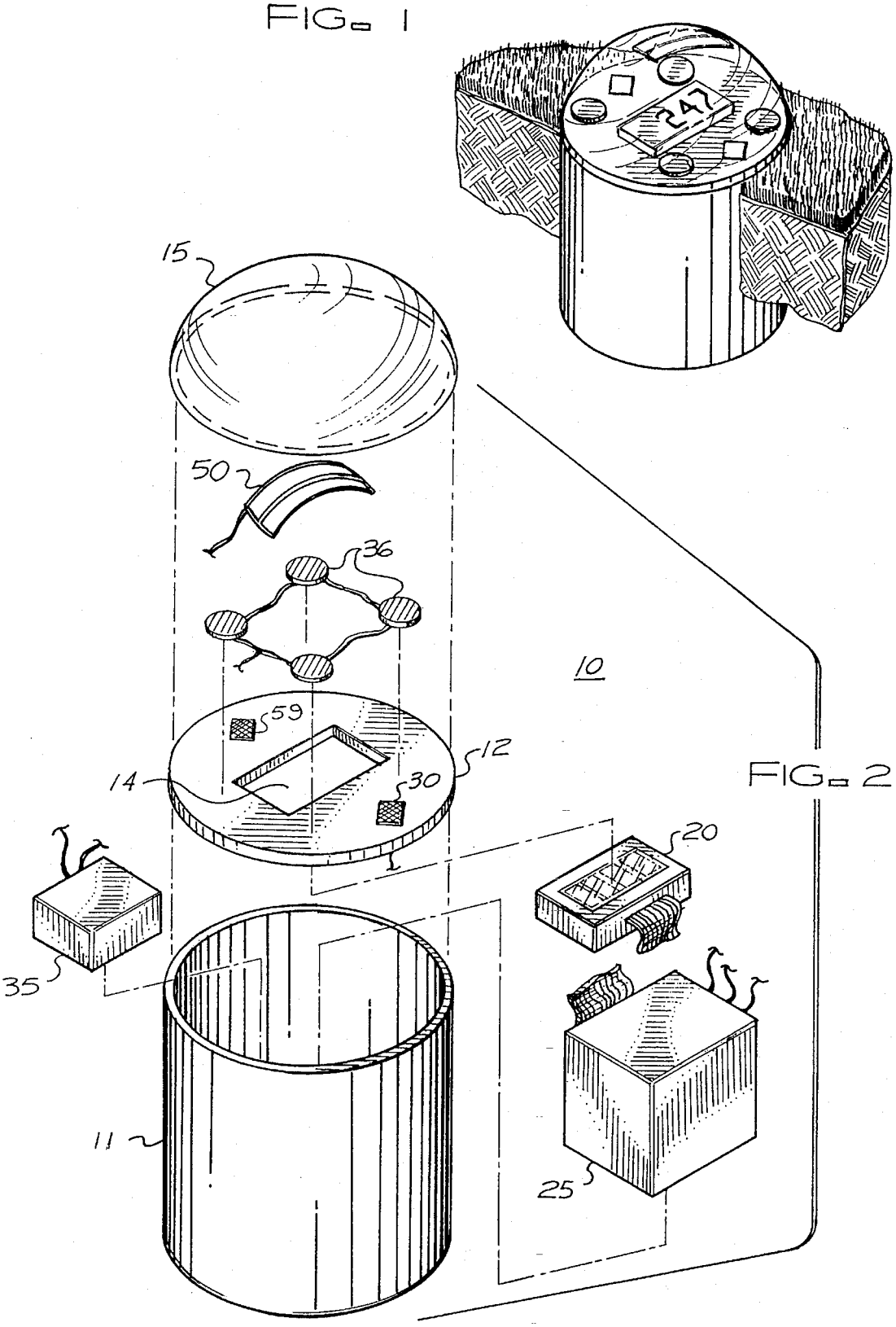
FIG. 1 is a perspective view of a variable distance marker as it would appear installed in the ground.
FIG. 2 is a simplified, exploded perspective view of a variable distance marker constructed in accordance with the present invention.

Turning now to the drawings in which like reference characters indicate corresponding elements, attention is first directed to FIGS. 1 and 2 which illustrates a variable distance marker 10 in accordance with the present invention. Marker 10 includes a housing 11, which in this specific embodiment has an upper end, or mounting base, 12 and an optically transparent dome 15. While a dome is disclosed in this embodiment for purposes of explanation, it will be understood that other configurations, such as a flat, clear cover can be utilized to overlie and protect the components from the elements. A display 20 includes an array of light emitting devices, such as a liquid crystal display (LCD), light emitting diodes (LEDs), or the like. Display 20 is electrically connected to electronics circuits 25 designed to control display 20 in response to signals applied thereto. Display 20 is mounted in an upper end 12 of housing 11, within a centrally located opening 14 so as to be visible through transparent dome 15. Further, dome 15 sealingly engages housing 11 so that the entire assembly can be fixedly mounted at a desired position, as for example, burying it in the ground with only dome 15 visible.

Generally, electronics circuits 25 includes circuitry which is commercially available but may, in some specific applications contain circuits designed especially for those specific applications. In the present embodiment electronics circuits 25 include a CPU, such as the commercially available 68HC11 or variations thereof. The CPU contains, or has associated therewith, a memory for storing certain data, which will be explained in more detail presently. The memory includes any of the well known memory devices such as, for example, RAMs, ROMs, PROMs, EPROMs, EEPROMs, etc.

Electronics circuits 25 further include a light detector 30, mounted in upper end 12 and operatively attached into electronics circuits 25 so as to generate control signals, in conjunction with electronics circuits 25, when a properly generated light is directed thereon. Generally, light detector 30 is sensitive to infrared light and the light may be modulated to produce, for example, digital signals. The digital signals, or modulated light, is coded in any of a plurality of well known methods to provide signals to electronics circuits 25, which in turn provide control signals to display 20 so that a selected number is displayed.

Typically a hand held, or portable, light generating device 40, as illustrated in FIG. 4, is utilized to generate the light signals. Device 40 includes a small plastic housing 41 having a plurality of control buttons 42 mounted therein. An internal light generator, such as a laser (not shown), is operably mounted in housing 41 so that when actuated by control buttons 42 light is emitted from end 43. The emitted light is highly directional and can easily be directed onto light detector 30. By depressing buttons 42 in an order corresponding to a desired number to be displayed by display 20, any desired number can be quickly and easily displayed. In a preferred embodiment, light generating device 40 is used by a local official, as he installs each variable distance marker 10 in a desired position in the ground, to preset a default distance to a desired point, such as a hole in the green of a golf course. A single hole on a golf course may employ a plurality of variable distance markers 10 located at varying distances, each one having a different default number.

In a somewhat different embodiment, device 40 can simply generate one or more constant beams of light at different phases or frequencies (utilizing one or more lasers). The default number is stored in the memory, which default number is normally displayed on display 20. When it is desired to change the default number, device 40 is directed at light detector 30 which activates a counter within electronics circuits 25 and adds to or subtracts from the default number, in a manner similar to setting most digital clocks.

Display 20 and electronics circuits 25 are powered by a convenient source of power such as, for example, a rechargeable battery 35 and an array of solar cells 36, an external power source, etc. Generally, variable distance marker 10 is only activated during the daylight hours and will be in a position to receive sunlight on solar cells 36. Also, in this embodiment solar cells 36 and display 20 are mounted on upper end 12 of housing 11 and dome 15 is formed of a clear material, such as plastic or the like so that display 20 can be easily seen externally and so that sunlight can reach solar cell array 36. Solar cells 36 generate electrical power, when sunlight impinges thereon, which electrical power is used to maintain a full charge on rechargeable battery 35.

Electronics circuits 25 also include a simple RF receiver, generally including an RF tuned filter and detector (not shown) connected to an RF antenna 50 positioned on dome 15. Antenna 50 can be a decal, thin metal strip, etc. and is connected to the RF receiver in any well known fashion. It will be understood that while antenna 50 is illustrated mounted on dome 15 it may be mounted internally if visibility through dome 15 is adversely effected. A remote RF transmitter 55, which may be located, for example, at the club house or other point where officials of the playing field are stationed, is used to transmit an activating signal to one or all of the variable distance markers 10.

Generally, in one specific method of utilizing the described structure, including especially distance marker 10, just after the position of a tee line 60 (see FIG. 5) or a hole 61 in the green have been altered, the local official determines how far they have been moved in plus or minus increments and then notifies the clubhouse by radio or phone, apprising them of the change in distance. Once this is done, the official at the clubhouse uses the RF transmitter to alter the display in variable distance marker, or markers, 10 from the default reading so that the variable distance marker indicates the new correct distance. It should of course be understood that variable distance markers 10 can be located at the tee line and any desired intermediate position or positions and that each variable distance marker is preset by the local official to the default reading. The official at the clubhouse can then reset each variable distance marker quickly and easily once he is apprised of the change in hole or tee positions. All of variable distance markers 10 for a single hole may be changed simultaneously since, although their default numbers are different, the changes in plus or minus increments are the same.

A second light sensor 60 is generally incorporated into electronics circuits 25 and mounted in upper end 12 of housing 11 to sense daylight and to turn electronics circuits 25 and display 20 off during the night and on during daylight hours.

It should now be understood that variable distance marker, or markers, 10 are activated by second light sensor 59 and display 20 is preset to a measured default distance by use of light generator 40 when variable distance marker 10 is first installed. Subsequently, any distance changes in position of the hole or tee can be introduced into electronics circuits 25 and, therefore, display 20 by an RF transmitter. In a slightly different method, or under special conditions, light source 40 could be used to completely reset display 20 to any desired number.

In some instances, it may be desirable to incorporate additional security in the system to insure that the correct numbers are displayed. In a such instances an official at an intermediate position of the playing field activates variable distance marker 10 by operating RF transmitter 55 to transmit the correct frequency. This is accomplished, for example, by pressing a number on a control panel 56, which number corresponds to a specific variable distance marker 10 it is desired to change. When variable distance marker 10 is activated, an official at the location of variable distance marker 10 utilizes hand-held light generator 40 to change display 20 to the correct reading. It should now be understood that a variety of combinations of light signals and/or RF signals can be utilized to set one or more distance markers 10 to desired distances.

Generally, while the display could be controlled directly with buttons, etc mounted thereon, this is not so desirable because of the potential for operation by unauthorized personal and because of the distances between variable distance markers 10. Thus, by providing a preset default number which can be changed from, for example, the clubhouse, a single official can quickly and easily change one or all of the variable distance markers on the entire golf course. Infrared light (or light at some specific frequency) is preferred for use in light generator 40 because there is less likelihood of inadvertent activation.

Thus, a new and novel distance marker is disclosed which is self contained (i.e., does not require outside power sources), which can easily be moved and fixedly or portably (temporarily) positioned at any desired location and can quickly, easily and reliably be altered to indicate any desired distance or number.

Various modifications and changes to the embodiments herein chosen for purposes of illustration will readily occur to those skilled in the art. For example, electronics circuits 25 can be formed in a variety of ways including CPUs, gate arrays, logic circuits, etc., while still performing the stated functions. Further, a variety of different materials may be utilized for dome 15 and base 12. Also, the manner or method of setting the display to the desired number may be performed in a variety of somewhat modified and/or interchanged steps.

The foregoing is given by way of example only. Other modifications and variations may be made by those skilled in the art without departing from the scope of the invention as defined by the following claims.

Having fully described and disclosed the present invention and preferred embodiments thereof in such clear and concise terms as to enable those skilled in the art to understand and practice same, the invention claimed is:

1. A variable, distance marker comprising:

a housing fixedly positioned on the ground adjacent a first of first and second spaced apart points;

a visual display electrically actuable and including a plurality of variable digits designed to indicate a specific distance in a range of distances between the first and second points and an input for receiving signals to actuate the display and change the digits in accordance with changes in the specific distance due to changed in the second of the spaced apart points, the visual display being mounted in the housing and viewable externally;

electronics circuits mounted in the housing and electrically connected to the visual display input for actuating the visual display to display selected digits indicative of a change in the specific distance between the first and second points as indicated by externally generated control signals;

means mounted in the housing and electrically connected to the electronics circuits for receiving externally generated control signals indicative of a pre-measured change in the specific distance and supplying the received control signals to the electronics circuits; and means connected to the visual display and the electronics circuits for supplying power thereto.

2. A variable, distance marker as claimed in claim 1 wherein the means for supplying power includes a rechargeable battery and a solar cell array connected to the battery for supplying power thereto.

3. A variable, distance marker as claimed in claim 1 wherein the means for receiving externally generated control signals includes a light detector.

4. A variable, distance marker as claimed in claim 3 further including remote portable light generator means controllable to generate control signals in the form of a directable beam of light for supplying externally generated control signals to the light detector.

5. A variable, distance marker as claimed in claim 1 wherein the means for receiving externally generated control signals includes an antenna coupled to the electronics circuits for receiving RF signals at a predetermined frequency and supplying the received signals to the electronics circuits.

6. A variable, distance marker as claimed in claim 5 wherein the received RF signals include an activating signal.

7. A variable, distance marker as claimed in claim 6 further including a remote RF transmitter controllable to transmit RF signals at the predetermined frequency.

8. A variable, distance marker as claimed in claim 1 wherein the visual display includes an array of LCDs.

9. A variable, distance marker as claimed in claim 1 wherein the visual display includes an array of LEDs.

10. A variable distance marker as claimed in claim 1 wherein the electronics circuits include a light sensor for sensing daylight and connected into the electronics circuits for turning the electronics circuits and the display off during darkness and on during daylight.

11. A variable distance marker system comprising:

a housing;

an electrically actuable, visual display including a plurality of variable digits and an input for receiving signals to actuate the display and change the digits, the visual display being mounted in the housing and viewable externally;

electronics circuits mounted in the housing and electrically connected to the visual display input, the electronics circuits being controllable to actuate the visual display to display selected digits;

a light detector mounted in the housing and electrically connected to the electronics circuits for receiving externally generated light signals, converting the received light signals into control signals and applying the control signals to the electronics circuits;

an antenna mounted in the housing and connected to the electronics circuits for receiving RF signals including an actuating signal at a predetermined frequency and applying the activating signal to the electronics circuits;

a rechargeable battery and a solar cell array connected to the battery for supplying power thereto, the rechargeable battery being connected to the visual display and the electronics circuits for supplying power thereto;

a remote portable light generator controllable to generate control signals in the form of a beam of light directable at the light detector; and a remote RF transmitter controllable to transmit RF signals to the antenna at the predetermined frequency.

12. A variable distance marker system as claimed in claim 11 wherein the visual display includes an array of LCDs.

13. A variable distance marker system as claimed in claim 11 wherein the visual display includes an array of LEDs.

14. A variable distance marker system as claimed in claim 11 wherein the electronics circuits include a light sensor for sensing daylight and connected into the electronics circuits for turning the electronics circuits and the display off during darkness and on during daylight.

15. A method of marking distances in a sporting event comprising the steps of:

providing a housing containing a visual display including a plurality of variable digits viewable externally, electronics circuits connected to the visual display and controllable to actuate the visual display to display selected digits, a light detector connected to the electronics circuits for receiving externally generated light signals, converting the received light signals into control signals and applying the control signals to the electronics circuits, an antenna mounted in the housing and connected to the electronics circuits for receiving RF signals including an actuating signal at a predetermined frequency and applying the actuating signal to the electronics circuits, and a rechargeable battery and interconnected solar cell array for supplying power to the visual display and the electronics circuits;

providing a remote portable light generator controllable to generate control signals in the form of a beam of light directable at the light detector;

providing an RF transmitter controllable to transmit RF signals to the antenna at the predetermined frequency and positioning the RF transmitter at a base point convenient to at least a first official for the sporting event;

selecting a designated position in a field of play for the sporting event, it being desirable for contestants to know the distance from the designated position to a first remote point;

positioning the housing in a convenient location at the selected designated position so that the visual display is readily discernable by the contestants;

operating the remote portable light generator to generate control signals in the form of a beam of light and directing the beam of light onto the light detector to actuate the visual display to indicate a preset default distance from the housing to the first remote point;

modifying the distance from the designated position to said first remote point;

determining the modified distance from the housing to the first remote point; and operating the RF transmitter to transmit an RF signal including an actuating signal to the antenna in the housing to modify the default distance so as to indicate the determined modified distance.

16. A method of marking distances in a sporting event as claimed in claim 15 wherein the step of operating the RF transmitter is performed by the first official and the steps of positioning the housing, determining the distance from the housing to the first remote point and operating the remote portable light generator are performed by a second official.

17. A method of marking distances in a sporting event as claimed in claim 16 wherein the sporting event is a golf game, the field of play is a golf course, the selected designated position is any position on the field of play and the first remote point is a hole.

18. A method of marking distances in a sporting event as claimed in claim 17 and further including the steps of:

providing a plurality of the housings;

positioning said housing adjacent said selected designated position;

determining the distance from each of the housings to the hole associated with each selected designated position; and operating the remote portable light generator to generate control signals in the form of a beam of light and directing the beam of light onto the light detector in each housing to actuate the visual display to preset the default distance from the housing to the associated hole.

19. A method of marking distances in a sporting event as claimed in claim 18 and further including the steps of modifying the distance from each of the housings to the hole associated with each said selected designated position, determining a modification distance of the step of modifying, and operating the RF transmitter to transmit an RF signal including an actuating signal to the antenna of each housing to alter the default distance by the modification distance.

* * * * *

UNITED STATES PATENT AND TRADEMARK OFFICE

CERTIFICATE OF CORRECTION

PATENT NO. : 5,532,677

DATED : 2 July 1996

INVENTOR(S) : JOHN E. MIILLER

It is certified that error appears in the above-indentified patent and that said Letters Patent is hereby corrected as shown below:

On the title page, item [19] and
At (76) of the cover page of the patent, replace "John E. Miller" with --John E. Miiller--.

Signed and Sealed this

Fourteenth Day of January, 1997

*Attest:*

*Attesting Officer*

BRUCE LEHMAN

*Commissioner of Patents and Trademarks*